US005305501A

United States Patent [19]

Ockba

[11] Patent Number: 5,305,501

[45] Date of Patent: Apr. 26, 1994

[54] SPRING CLIP

[76] Inventor: Ali M. A. Ockba, PO Box 10627, Sana'a, Yemen (Sana)

[21] Appl. No.: 24,285

[22] Filed: Mar. 1, 1993

[51] Int. Cl.[5] ..... B42F 1/00

[52] U.S. Cl. ..... 24/67.7; 24/67.5; 24/508

[58] Field of Search ..... 24/67.7, 67.5, 67.3, 24/67.1, 67.11, 67 R, 489, 508, 509, 511

[56] References Cited

U.S. PATENT DOCUMENTS

| | | | |
|---|---|---|---|
| 2,548,536 | 4/1951 | Johnson | 24/508 |
| 3,196,564 | 7/1965 | Boedeker | 24/67 R |
| 3,310,901 | 3/1967 | Sarkisian | 24/67.7 |
| 3,597,813 | 8/1971 | Takahashi | 24/67.5 |
| 4,562,618 | 1/1986 | Masuda | 24/67.7 |

*Primary Examiner*—Victor N. Sakran
*Attorney, Agent, or Firm*—Leon Gilden

[57] ABSTRACT

A spring clip is arranged to include confronting first and second clamp plates biased together by a spring member mounted between first and second actuator plates, with the actuator plates biased towards one another by the spring member. The first and second actuator plates are arranged in a parallel fixed relationship relative to the first and second clamp plates and pivotal relative to one another about an axle shaft. The first and second clamp plates include resilient engaging projections to enhance securement of a paper workpiece directed therebetween. Further, second actuator plates of a plurality of the spring clip members may be assembled together by utilizing fastener plugs directed through the respective second actuator plates.

5 Claims, 4 Drawing Sheets

SPRING CLIP

BACKGROUND OF THE INVENTION

1. Field of the Invention

The field of invention relates to paper clip structure, and more particularly pertains to a new and improved spring clip wherein the same is arranged to secure workpieces, and particularly flexible web workpieces together.

2. Description of the Prior Art

Clamp structure of various types have been utilized throughout the prior art to permit the securement and fastening of various paper webs together. Such clip structure is exemplified in the U.S. Pat. No. 4,562,618; 4,594,016; 3,531,841; and U.S. Design Pat. No. 257,924.

The mounting of various files together in a convenient and accessible manner as addressed by and exemplified in the prior art has heretofore been arranged to confront various problems in the association of such file structure. The instant invention attempts to overcome deficiencies of the prior art in addressing the securement of a plurality of clip members together, as well as the positive mounting of various filing webs to include sheets of paper and the present invention sets forth such structure in a convenient and compact organization and in this respect, the present invention sets forth improvements of the prior art not addressed therein.

SUMMARY OF THE INVENTION

In view of the foregoing disadvantages inherent in the known types of clamp structure now present in the prior art, the present invention provides a spring clip wherein the same is arranged to engage a paper web member between confronting projections of confronting clamp plates. As such, the general purpose of the present invention, which will be described subsequently in greater detail, is to provide a new and improved spring clip which has all the advantages of the prior art spring clip structure and none of the disadvantages.

To attain this, the present invention provides a spring clip arranged to include confronting first and second clamp plates biased together by a spring member mounted between first and second actuator plates, with the actuator plates biased towards one another by the spring member. The first and second actuator plates are arranged in a parallel fixed relationship relative to one another about an axle shaft. The first and second clamp plates include resilient engaging projections to enhance securement of a paper workpiece directed therebetween. Further, second actuator plates of a plurality of the spring clip members may be assembled together by utilizing fastener plugs directed through the respective second actuator plates.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved spring clip which has all the advantages of the prior art spring clip structure and none of the disadvantages.

It is another object of the present invention to provide a new and improved spring clip which may be easily and efficiently manufactured and marketed.

It is a further object of the present invention to provide a new and improved spring clip which is of a durable and reliable construction.

An even further object of the present invention is to provide a new and improved spring clip which is susceptible of a low cost of manufacture with regard to both materials and labor, and which accordingly is then susceptible of low prices of sale to the consuming public, thereby making such spring clips economically available to the buying public.

Still yet another object of the present invention is to provide a new and improved spring clip which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
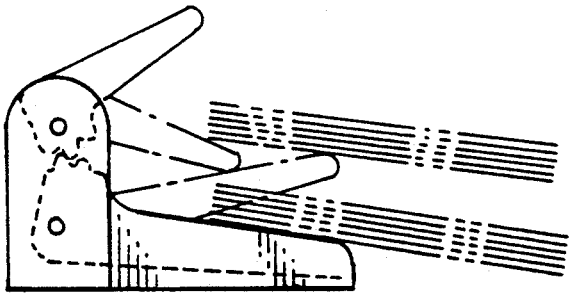
FIG. 1 PRIOR ART
FIG. 1 and FIG. 2 set forth a spring clip structure, of a type as indicated in the U.S. Pat. No. 4,562,618.

With reference now to the drawings, and in particular to FIGS. 1 to 7 thereof, a new and improved spring clip embodying the principles and concepts of the present invention and generally designated by the reference numeral 10 will be described.

Figure 2:
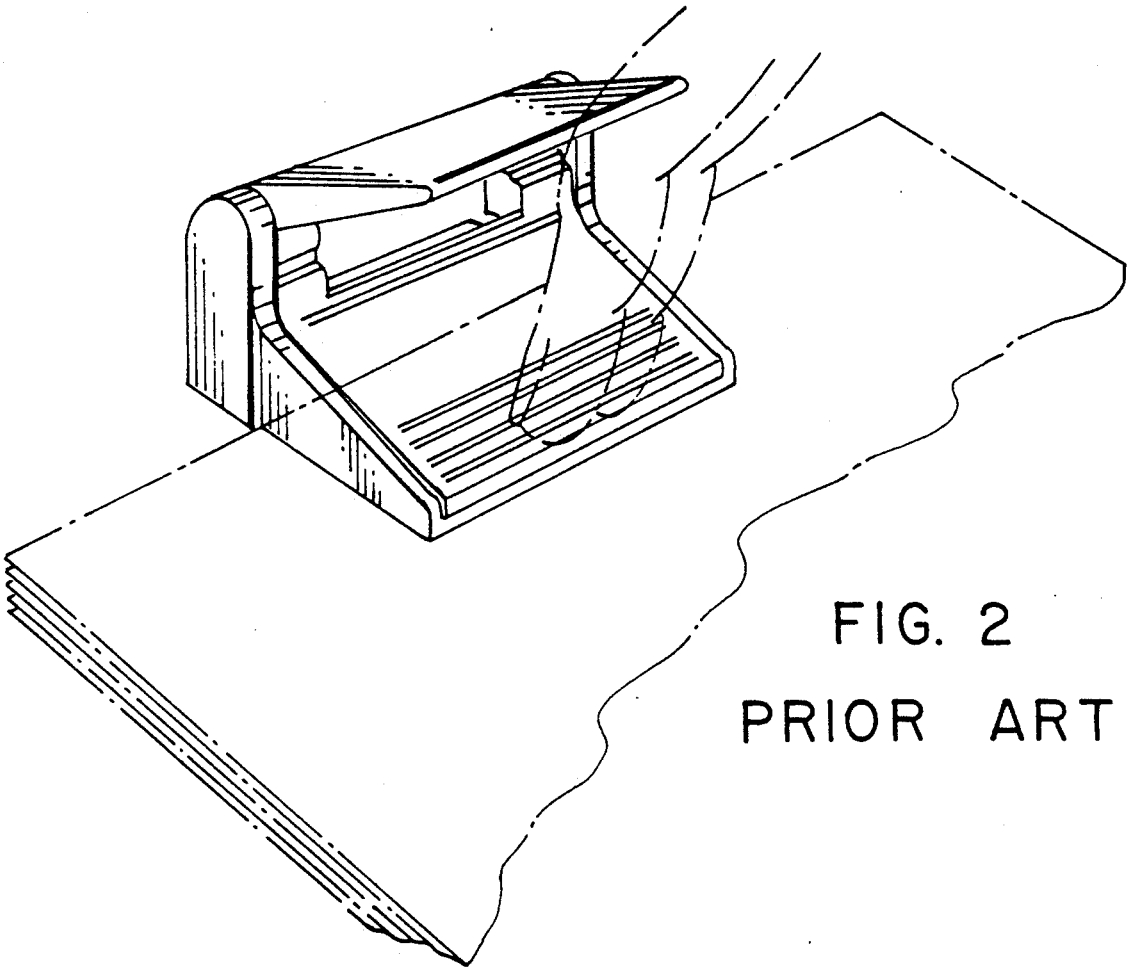
FIG. 2 PRIOR ART

The FIGS. 1 and 2 indicate the use of the spring clip structure as set forth in U.S. Pat. No. 4,562,618 to provide for clamping jaw structure to secure paper webs therebetween.

More specifically, the spring clip 10 of the instant invention essentially comprises a first clamp plate 11 having a first clamp first end 12 spaced from a first clamp plate second end 13 in a parallel relationship, including a second end recess 14 directed into the first clamp plate 11 from the second end 13 medially of the second end. A second end axle shaft 15 is fixedly mounted with the first clamp plate second end extending colinearly therewith over the second end recess 14. A first actuator plate 16 is fixedly mounted to the axle shaft 15 diametrically opposed to the mounting of the first clamp plate second end thereto, with the first actuator plate 16 having a first actuator plate first end 17, as noted above, mounted to the axle shaft 15, and a first actuator plate second end 20 spaced from and parallel the first actuator plate first end 17. A first end recess 19 is directed into the first actuator plate 16 from the first end 17 medially thereof and at least coextensive with the second end recess 14. A second clamp plate 21 is provided having a second clamp plate first end spaced from and parallel a second clamp plate second end 22 and 23 respectively. The sides of the second clamp plate 21 are canted from the first end 22 towards one another to the second end 23, with the second clamp plate second end positioned coextensive with the first recess and the second recess, having an axle shaft pivot tube 25 fixedly mounted to the second clamp plate second end 23 receiving the axle shaft therewithin. For purposes of illustration, the axle shaft pivot tube 25 is indicated as split, but it is to be understood that it is of a unitary construction when the clip structure is in an assembled configuration, such as indicated in the FIGS. 6 and 7 for example.

Figure 3:
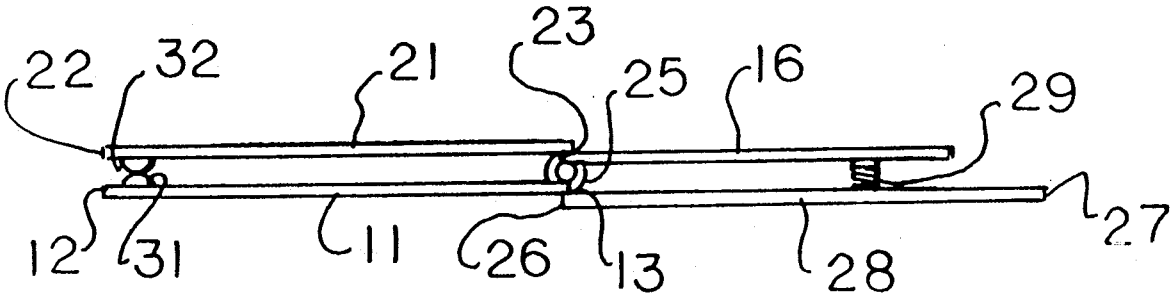
FIG. 3 is an orthographic side view of the invention.
Figure 4:
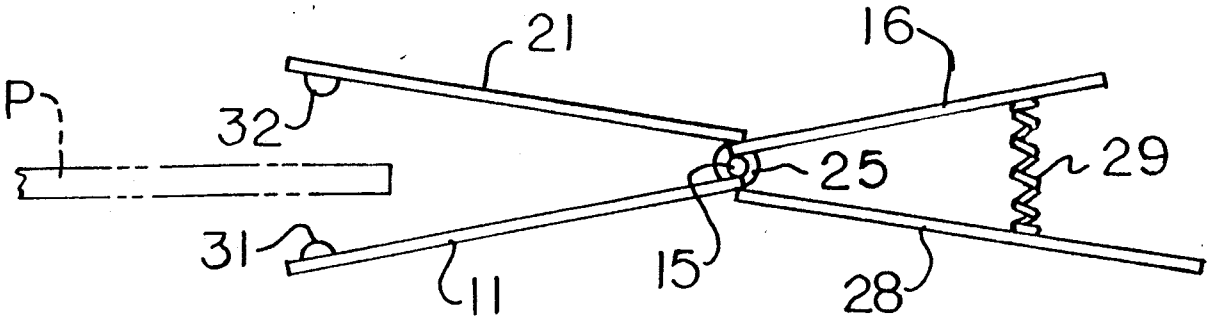
FIG. 4 is an orthographic side view of the invention in an orientation to displace the first clamp plate relative to the second clamp plate to accept a paper workpiece therebetween.
Figure 5:
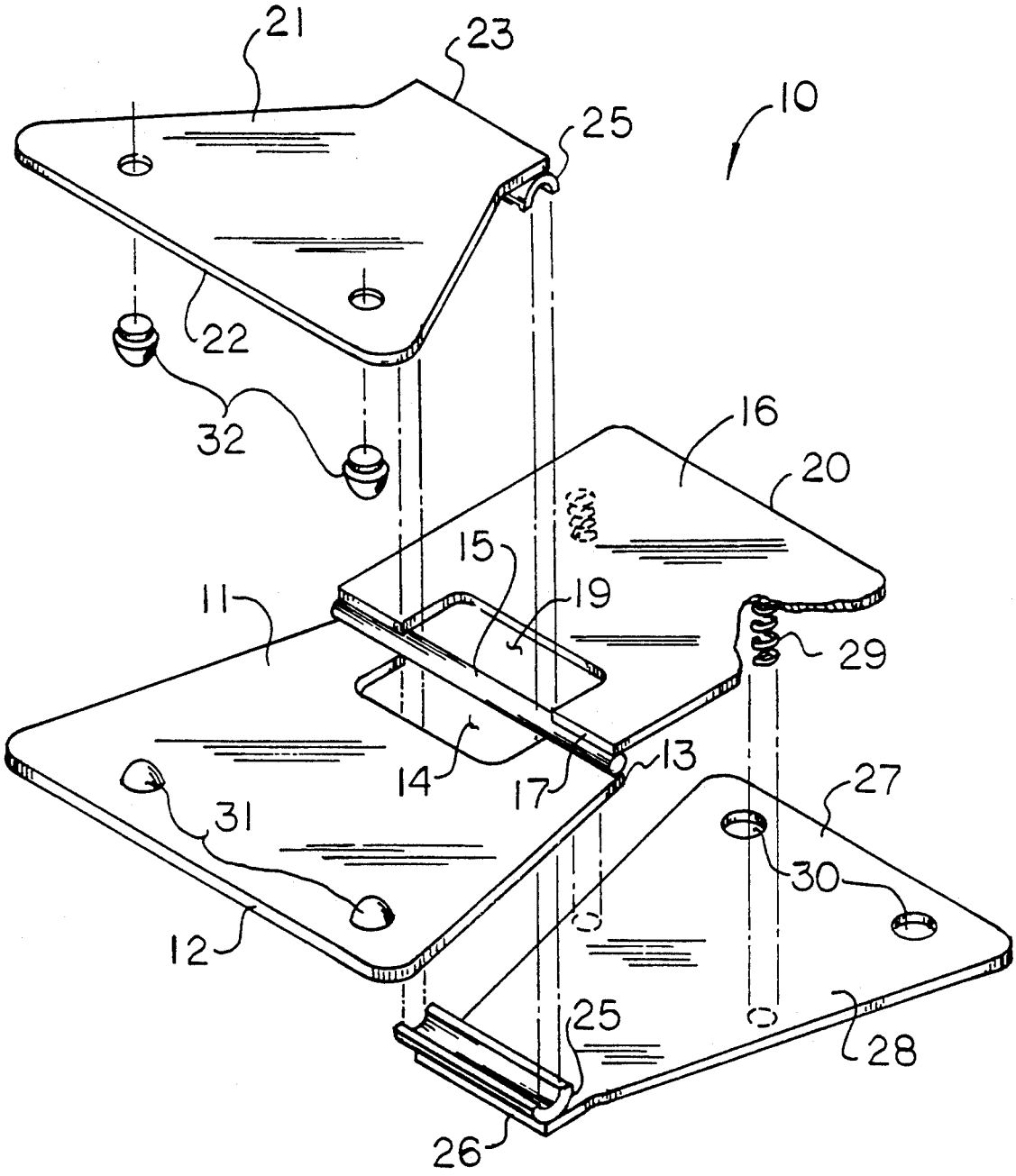
FIG. 5 is an isometric exploded illustration of the invention.

The second actuator plate 28 is fixedly mounted to the pivot tube 25 diametrically opposed to the second clamp plate, with the second actuator plate 28 arranged parallel relative to the second clamp plate 21, wherein similarly, the first actuator plate 16 is arranged parallel relative to the first clamp plate 11, such as indicated in FIG. 3. A second actuator plate first end 26 is spaced from and parallel a second actuator plate 27 and as noted, the second actuator plate first end 26 is fixedly mounted diametrically opposed to the second clamp plate second end 23 about the pivot tube 25. A plurality of second end actuator plate apertures 30 are directed into the second actuator plate equally spaced from the second actuator plate second end 27 for purposes to be described in more detail below. A spring member 29 is interposed between confronting surfaces of the first actuator plate and the second actuator plate to bias the actuator plates together, in a manner as indicated in FIG. 3, wherein to receive a paper "P" between the first and second clamp plates, manual spreading of the first and second actuator plates in a spaced relationship relative to one another is required, as indicated in FIG. 4.

First resilient bumper projections 31 are mounted to the first clamp plate spaced a predetermined spacing from the first clamp plate first end 12, with second resilient bumper projections 32 mounted to the second clamp plate an equal spacing from the second clamp plate first end, wherein the first and second projections 31 and 32 are each aligned with at least one of the second projections 32.

Figure 6:
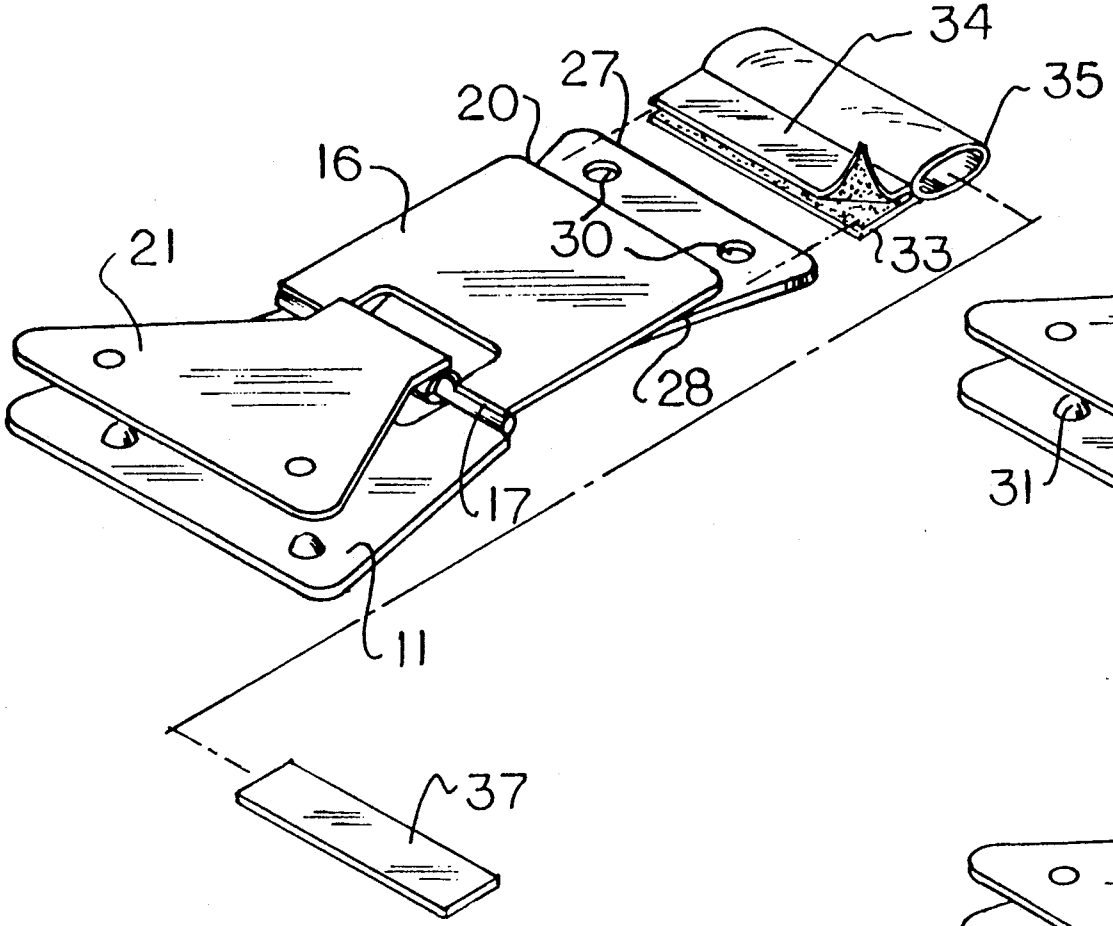
FIG. 6 is an isometric illustration of the invention utilizing the adherence of a marking tab thereto.

The FIG. 6 indicates the use of first and second adhesive sheets 33 and 34 arranged for securement to the first clamp plate second end 20, having a tube member 35 mounted thereto to receive a message plate therewithin for identification of various papers secured by the organization.

Figure 7:
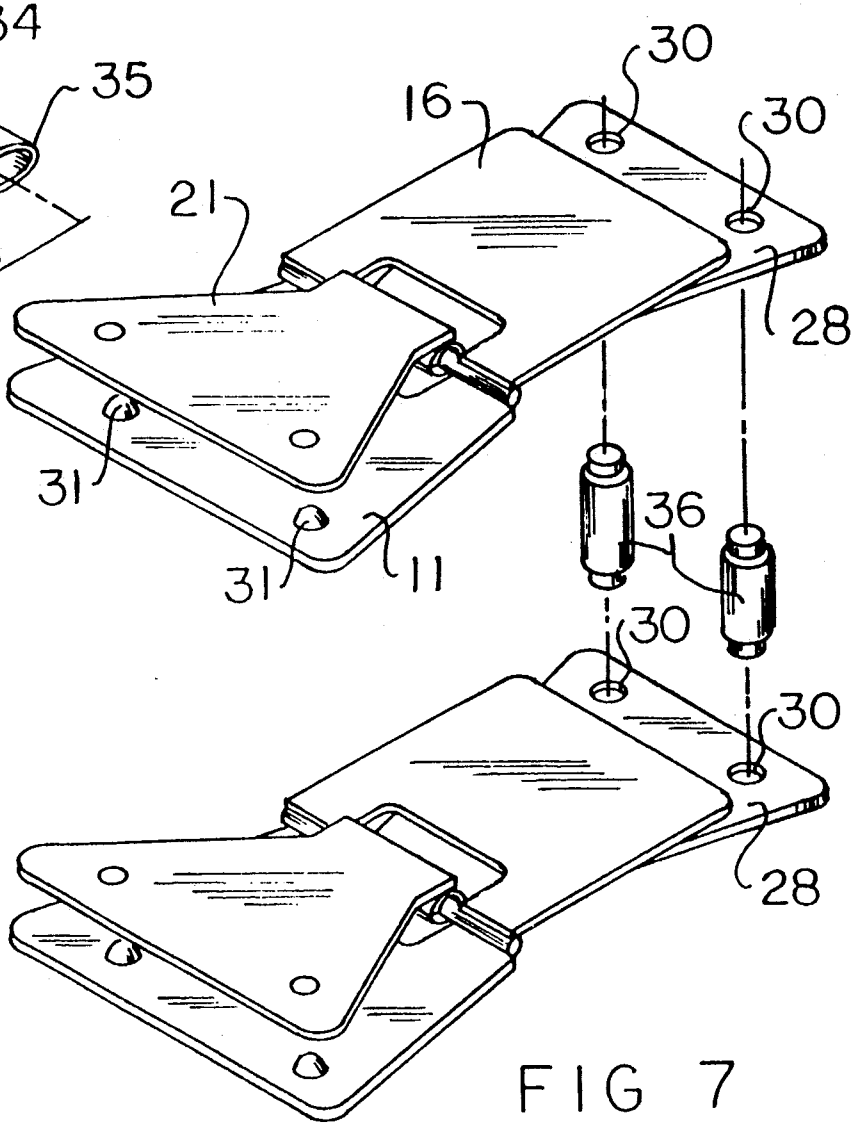
FIG. 7 is an isometric illustration of the invention arranged to secure a plurality of the clip members together.

The FIG. 7 indicates the use of resilient fastener plugs 36 arranged for securement to respective second actuator plates of adjacent spring clip members 10, wherein the resilient fastener plugs 36 each include projections to be received within coaxially aligned second actuator plate apertures 30 to secure the plurality of clip members together for the assemblage of plural groups of documents.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A spring clip structure, comprising, at least one clip assembly having a first clamp plate, the first clamp plate including a first clamp plate first end spaced from and to parallel a first clamp plate second end, and a second end recess directed into the first clamp plate medially of the first clamp plate second end, and an axle shaft mounted to the first clamp plate second end extending colinearly with the first clamp plate second end over the second end recess, and a first actuator plate having a first actuator plate first end spaced from and to parallel a first actuator plate second end, with the first actuator plate first end fixedly mounted to the axle shaft diametrically opposed to the first clamp plate second end, and a first end recess directed into the first actuator plate from the first actuator plate first end coextensive with the second end recess, and a second clamp plate having a second clamp plate first end and a second clamp plate second end, and a pivot tube mounted to the second clamp plate second end receiving the axle shaft therewithin within the second end recess and the first end recess, and a second actuator plate mounted to the pivot tube diametrically opposed to the second clamp plate second end extending along the first actuator plate, with the second actuator plate second end extending beyond the first actuator plate second end.

2. A spring clip as set forth in claim 1 wherein spring means are fixedly mounted between the first actuator plate and the second actuator plate for biasing the first actuator plate towards the second actuator plate, and the first clamp towards the second clamp plate.

3. A spring clip as set forth in claim 2 wherein first resilient projections are mounted on the first clamp plate a predetermined spacing from the first clamp plate first end, and second resilient projections mounted on the second clamp plate said predetermined spacing from the second clamp plate second end, wherein at least one of the first projections is coaxially aligned with one of the second projections.

4. A spring clip as set forth in claim 3 including a adhesive first sheet and a second sheet mounted to the first actuator plate at the first actuator plate second end having a tube member mounted to the first sheet and the second sheet, the tube member receiving a message plate therewithin, and the tube member being transparent.

5. A spring clip as set forth in claim 4 wherein the second actuator plate includes a plurality of second actuator plate apertures directed therethrough, wherein the second actuator plate apertures are oriented beyond the first actuator plate second end, and a second clamp assembly having a second clamp assembly second actuator plate, and the second clamp assembly second actuator plate includes further apertures directed through the second clamp assembly second actuator plate, and one of the further apertures and one of the apertures include a resilient plug member directed therethrough to secure the first clamp assembly to the second clamp assembly.

* * * * *